US008776911B2

(12) United States Patent
Lee et al.

(10) Patent No.: US 8,776,911 B2
(45) Date of Patent: Jul. 15, 2014

(54) HYDRAULIC BREAKER

(76) Inventors: Young Seok Lee, Incheon (KR); Byeong Seo Goo, Gwangmyeong-si (KR)

( * ) Notice: Subject to any disclaimer, the term of this patent is extended or adjusted under 35 U.S.C. 154(b) by 406 days.

(21) Appl. No.: 13/319,449

(22) PCT Filed: May 20, 2010

(86) PCT No.: PCT/KR2010/003212
§ 371 (c)(1),
(2), (4) Date: Nov. 22, 2011

(87) PCT Pub. No.: WO2010/137826
PCT Pub. Date: Dec. 2, 2010

(65) Prior Publication Data

US 2012/0067606 A1 Mar. 22, 2012

(30) Foreign Application Priority Data

May 25, 2009 (KR) ..... 20-2009-0006280 U

(51) Int. Cl.
*B25D 17/28* (2006.01)
*E21B 4/14* (2006.01)

(52) U.S. Cl.
USPC ..... 173/115; 173/128; 173/162.1; 173/200; 173/206; 173/212

(58) Field of Classification Search
USPC ..... 173/29, 89, 115, 128, 162.1, 200, 206, 173/210, 212
See application file for complete search history.

(56) References Cited

U.S. PATENT DOCUMENTS

| | | | | |
|---|---|---|---|---|
| 4,724,912 | A * | 2/1988 | Miyazaki et al. | 173/162.1 |
| 6,095,257 | A * | 8/2000 | Lee | 173/211 |
| 6,227,307 | B1 * | 5/2001 | Lee | 173/78 |
| 6,732,814 | B2 * | 5/2004 | Heinonen et al. | 173/199 |
| 7,111,691 | B2 * | 9/2006 | Siltanen et al. | 173/200 |
| 7,207,633 | B2 * | 4/2007 | Wittenberg et al. | 299/37.5 |
| 7,380,611 | B2 * | 6/2008 | Ostling | 173/28 |
| 7,628,222 | B2 * | 12/2009 | Yoshimura et al. | 173/162.1 |
| 8,061,439 | B2 * | 11/2011 | Nelson | 173/210 |
| 8,146,677 | B2 * | 4/2012 | Kim | 173/115 |
| 8,181,716 | B2 * | 5/2012 | Robson | 173/210 |

FOREIGN PATENT DOCUMENTS

| | | | |
|---|---|---|---|
| JP | 11254351 | A | 9/1999 |
| JP | 2005299091 | A | 10/2005 |
| JP | 2008114300 | A | 5/2008 |
| KR | 100456768 | B1 | 11/2004 |

* cited by examiner

*Primary Examiner* — Scott A. Smith
(74) *Attorney, Agent, or Firm* — Novick, Kim & Lee, PLLC; Jae Youn Kim

(57) ABSTRACT

Disclosed is a hydraulic breaker. The hydraulic breaker includes a back head provided therein with a gas chamber; a cylinder assembled to a lower portion of the back head; a front head assembled to a lower portion of the cylinder; a piston moving up and down in the cylinder; and a chisel installed in the front head, wherein semicircular ring slots are defined in both sides of a bottom of the back head, both sides of a top of the cylinder, both sides of a bottom of the cylinder and both sides of a top of the front head, respectively, and fastening rings are installed in circular ring slots formed by joining the semicircular ring slots formed in both sides of the bottom of the back head to the semicircular ring slots formed in both sides of the top of the cylinder, and the fastening rings are installed in circular ring slots formed by joining the semicircular ring slots formed in both sides of the bottom of the cylinder to the semicircular ring slots formed in both sides of the top of the front head in order to assemble the back head, cylinder, and front head with each other.

2 Claims, 5 Drawing Sheets

HYDRAULIC BREAKER

TECHNICAL FIELD

The present invention relates to a hydraulic breaker installed on construction equipment, such as excavators, and extensively used for breaking rocks, concrete, etc. More particularly, the present invention relates to a hydraulic breaker capable of simply assembling a back head with a cylinder and the cylinder with a front head without using a fastening bolt having a long length.

BACKGROUND ART

A hydraulic breaker according to the present invention is installed on construction equipment, such as excavators, and extensively used for breaking rocks, concrete, etc. When a piston moves down in a cylinder due to fluid pressure, the piston strikes an upper portion of a chisel serving as an excavating tool, so that the chisel breaks the rocks or concrete.

FIG. 1 is a perspective view showing a hydraulic breaker according to the related art, and FIG. 2 is an exploded perspective view showing main components of the hydraulic breaker according to the related art.

In general, as shown in FIGS. 1 and 2, the hydraulic breaker includes a back head 210 provided therein with a gas chamber therein; a cylinder 220 assembled to a lower portion of the back head 210; a front head 230 assembled to a lower portion of the cylinder 220; a piston 240 moving up and down in the cylinder; and a chisel 250 installed in the front head 230.

The gas chamber provided in the back head 210 is filled with gas. When the piston 240 moves up in the cylinder 220, the gas in the gas chamber is compressed. When the piston 240 moves down, the compressed gas pushes an upper portion of the piston 240.

In addition, a valve and an accumulator are installed outside the cylinder 220 provided therein with the piston 240. As the valve operates, fluid pressure is supplied. If the fluid pressure is not supplied through the valve due to the rapid operation, the accumulator is operated to properly supply the fluid pressure.

The chisel 250 is installed in the front head 230 assembled to the lower portion of the cylinder 220. As the piston 240 strikes the chisel 250 while moving down in the cylinder 220, the chisel 250 breaks the rocks or concrete.

Meanwhile, according to the hydraulic breaker 200 of the related art shown in FIGS. 1 and 2, in order to assemble the back head 210, the cylinder 220 and the front head 230 with each other, perforation holes 211 and 221 are formed at each corner of the back head 210 and the cylinder 220, fastening holes 231 are formed at each corner of an upper surface of the front head 230, and nut assembling grooves 231 are formed below each fastening hole 231 of the front head 230 such that lower nuts 262 can be fastened in the nut assembling grooves 231.

According to the hydraulic breaker 200 of the related art, after the cylinder 220 and the back head 210 have been placed on the front head 230, a fastening bolt 260 is inserted into the fastening hole 231 of the front head 230 by passing through the perforation hole 211 of the back head 210 and the perforation hole 221 of the cylinder 220. Then, an upper nut 261 and the lower nut 261 are fastened to upper and lower ends of the fastening bolt 260.

That is, according to the hydraulic breaker 200 of the related art, when the back head 210, the cylinder 220 and the front head 230 are assembled with each other, the lower nut 262, which is specifically designed, is fastened to the lower end of the fastening bolt 260 inserted into the front head 230 by passing through the back head 210 and the cylinder 220. Then, the fastening bolt 260 is fastened by a torque wrench from the top of the back head 210. However, since the length of the fastening bolt 260, which is specifically designed to assemble the back head 210, the cylinder 220 and the front head 230 with each other, is too long, the fastening bolt 260 may be fastened in a state that the fastening bolt 260 is biased. In this case, when the construction work is performed by installing the hydraulic breaker 200 on an excavator, the biased fastening bolt 260 may return to its initial position as vibration is applied thereto, so tension of the fastening bolt 260 may be released. Thus, it is necessary to fasten again the upper nut 261 and the lower nut 262.

If the construction work continues without fastening the upper and lower nuts 261 and 262 due to the carelessness or the lack of common sense for construction equipment, the striking force of the chisel 250 may be degraded, the fastening bolt 260 may be broken, and main components of the cylinder 220 may be damaged.

DISCLOSURE

Technical Problem

The present invention has been made to solve the above problems occurring in the hydraulic breaker of the related art, and an object of the present invention is to provide a hydraulic breaker, which can simply and securely assemble a back head provided therein with a gas chamber, a cylinder provided therein with a piston moving up and down, and a front head for installing a chisel with each other and can be stably operated without causing damage to the components.

Technical Solution

In order to accomplish the above object, the present invention provides a hydraulic breaker, in which fastening rings are installed between both sides of the bottom of the back head and both sides of the top of the cylinder and between both sides of the bottom of the cylinder and both sides of the top of the front head, respectively, in order to assemble a back head, a cylinder, and a front head with each other.

According to the present invention, there is provided a hydraulic breaker including a back head provided therein with a gas chamber; a cylinder assembled to a lower portion of the back head; a front head assembled to a lower portion of the cylinder; a piston moving up and down in the cylinder; and a chisel installed in the front head, wherein semicircular ring slots are defined in both sides of a bottom of the back head, both sides of a top of the cylinder, both sides of a bottom of the cylinder and both sides of a top of the front head, respectively, and fastening rings are installed in circular ring slots formed by joining the semicircular ring slots formed in both sides of the bottom of the back head to the semicircular ring slots formed in both sides of the top of the cylinder, and the fastening rings are installed in circular ring slots formed by joining the semicircular ring slots formed in both sides of the bottom of the cylinder to the semicircular ring slots formed in both sides of the top of the front head, respectively, in order to assemble the back head, the cylinder, and the front head with each other.

According to the exemplary embodiment of the present invention, pin holes are formed in a front and a rear of the bottom of the back head and a front and a rear of the top of the cylinder in correspondence with each other, and the pin holes are formed in a front and a rear of the bottom of the cylinder and a front and a rear of the top of the front head in correspondence with each other, wherein position fixing pins are installed in the pin holes formed in the bottom of the back head and the top of the cylinder in correspondence with each other, and the position fixing pins are also installed in the pin holes formed in the bottom of the cylinder and the top of the front head in correspondence with each other, in such a manner that the position fixing pins serve as an assembling guide while permitting the fastening rings to be stably fastened against rotation in forward or reverse direction.

Advantageous Effect

According to the present invention, since the fastening bolt having a long length is not used to assemble the back head, the cylinder, and the front head with each other, the hydraulic breaker can be stably operated without causing the bias of the fastening bolt, the release of the nut and the damage of the components. In addition, the perforation holes of the back head and the cylinder and the nut assembling holes of the front head can be omitted, so that the component processing work can be facilitated. Further, the components can be readily assembled with each other by the fastening rings, so that the cost for processing and assembling the components can be significantly reduced.

BEST MODE

Mode for Invention

Hereinafter, exemplary embodiments of the present invention will be described in detail with reference to accompanying drawings.

Figure 1:
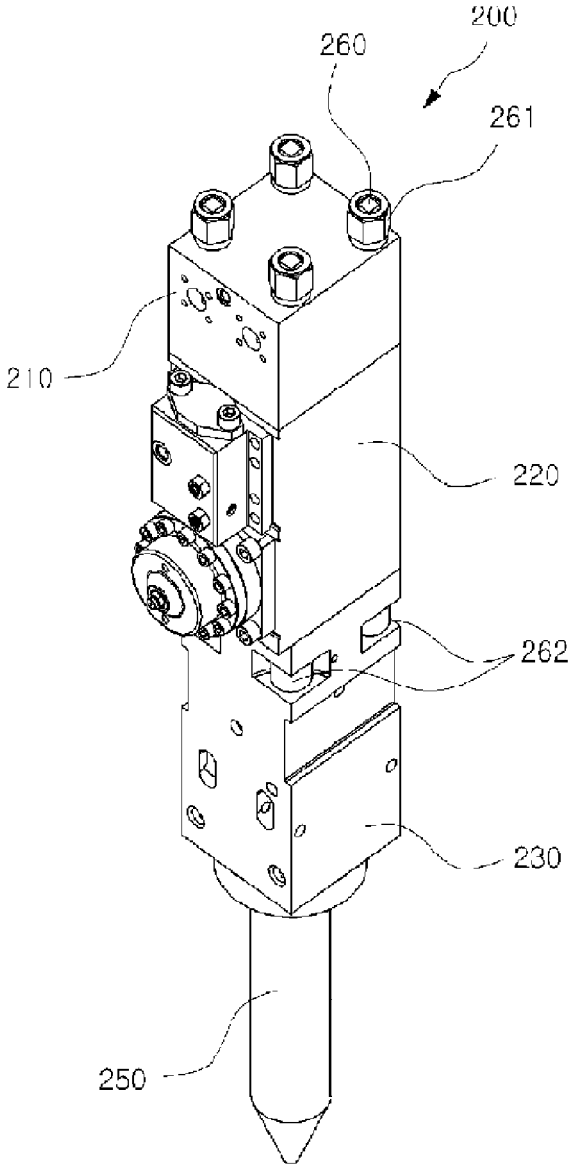
Fig.1 PRIOR ART
FIG. 1 is a perspective view showing a hydraulic breaker according to the related art.
Figure 2:
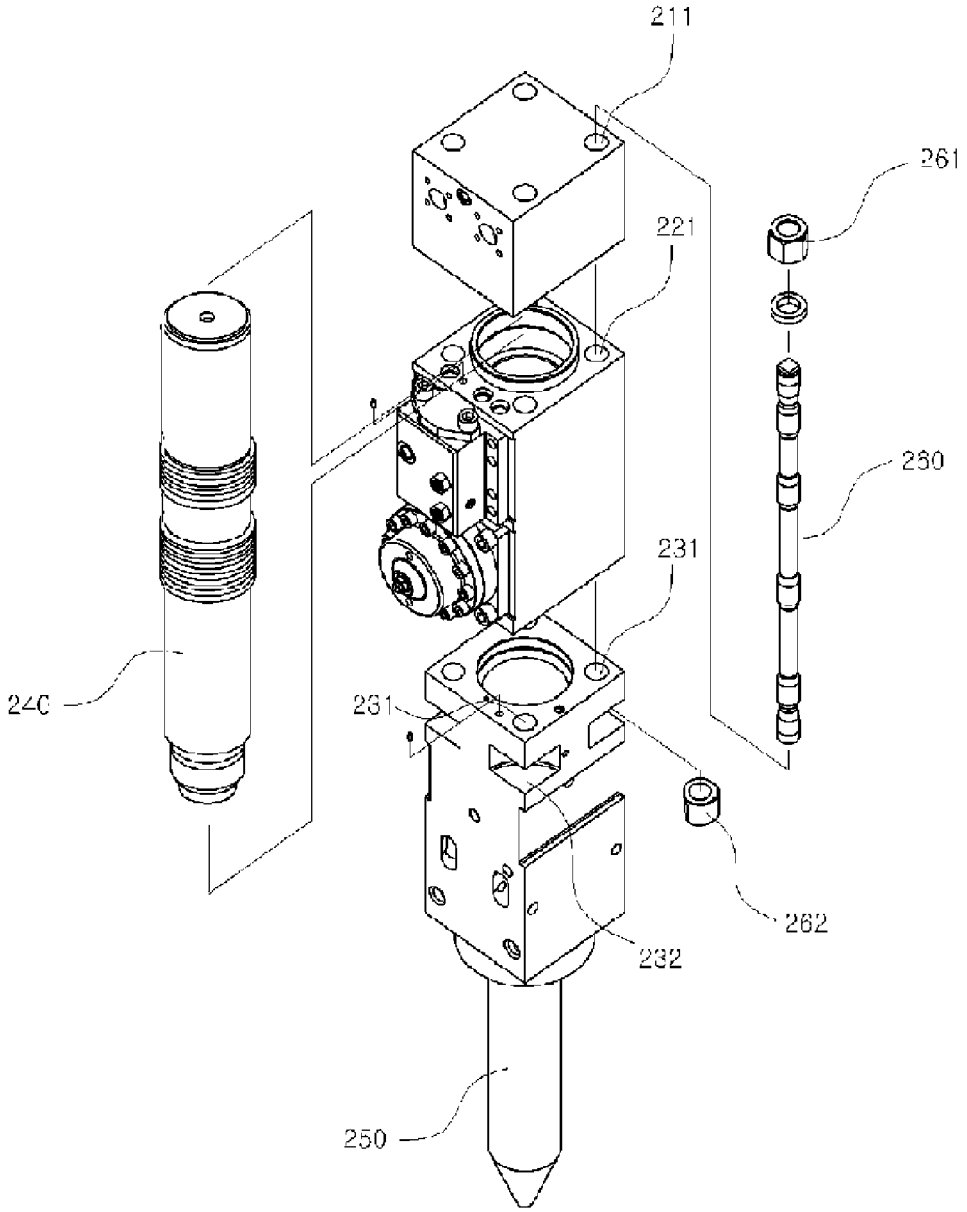
Fig.2 PRIOR ART
FIG. 2 is an exploded perspective view showing main components of the hydraulic breaker according to the related art.
Figure 3:
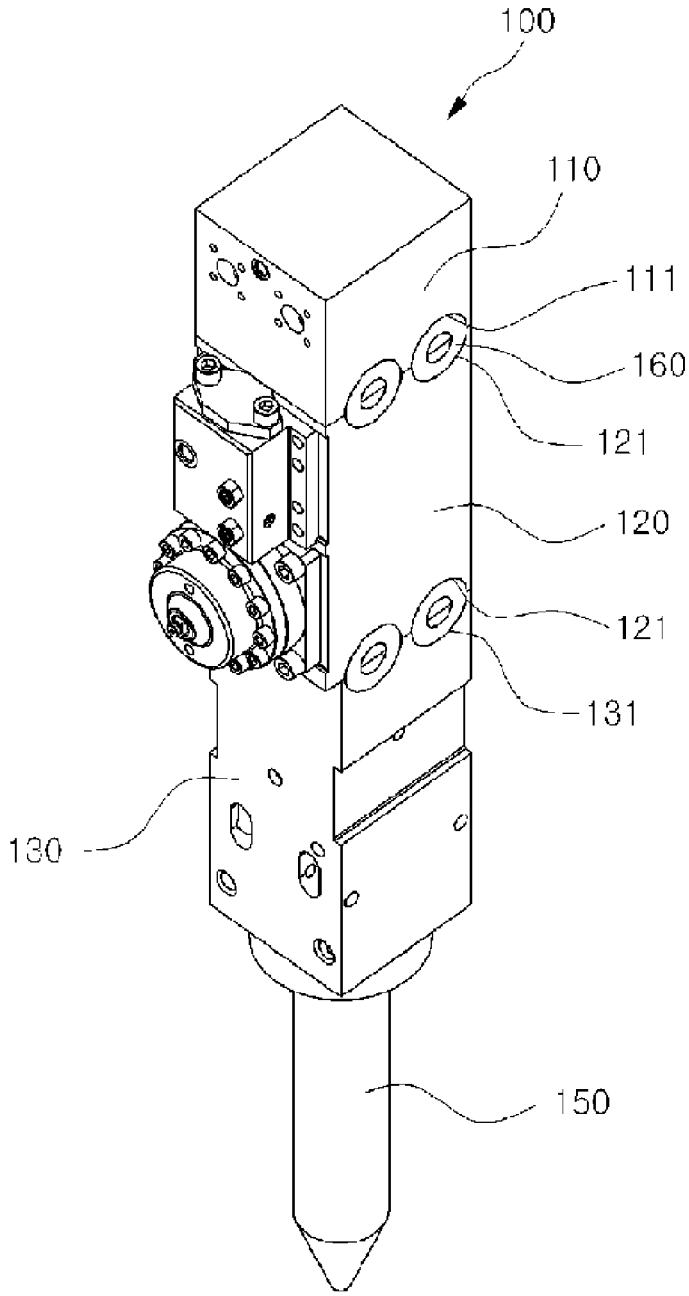
FIG. 3 is a perspective view showing a hydraulic breaker according to one embodiment of the present invention.
Figure 4:
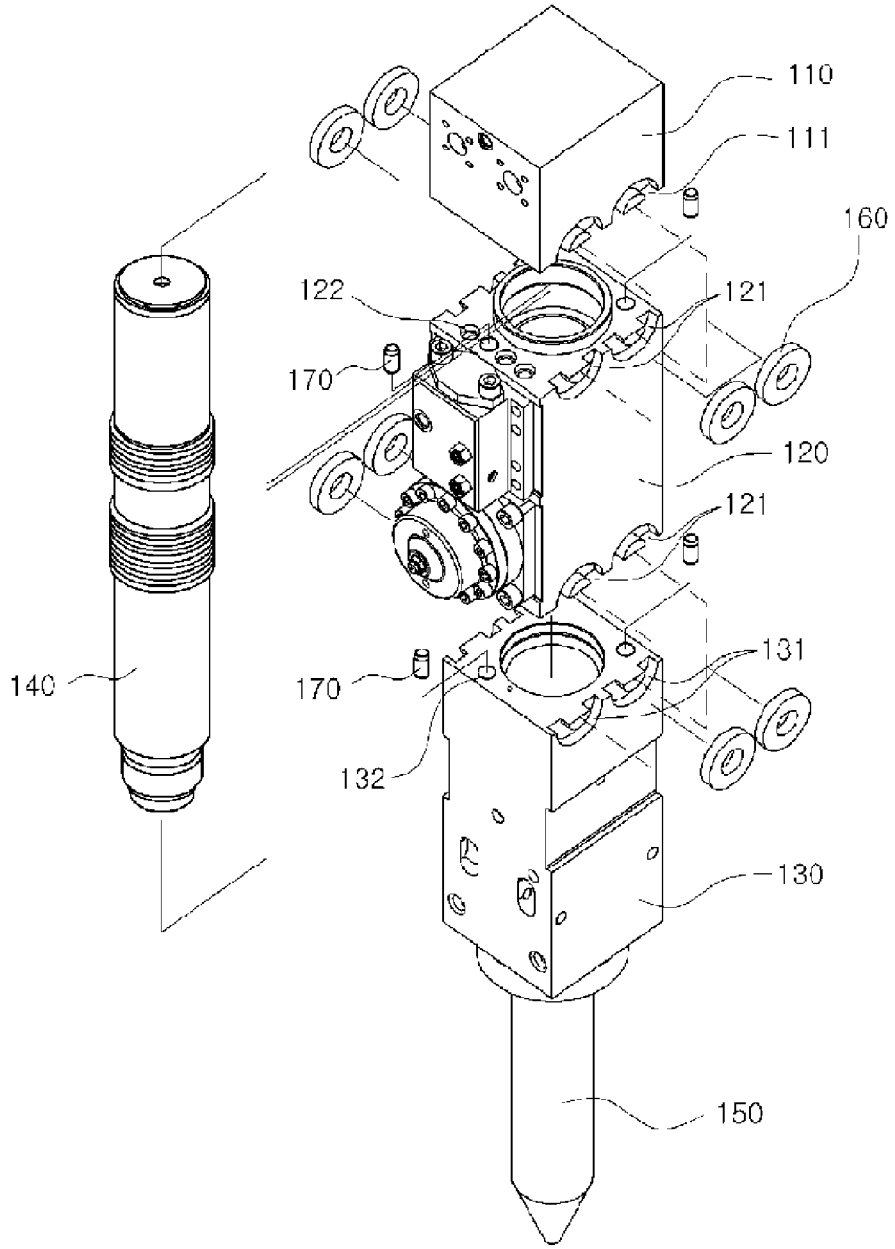
FIG. 4 is an exploded perspective view showing main components of the hydraulic breaker according to one embodiment of the present invention.

FIG. 3 is a perspective view showing a hydraulic breaker according to one embodiment of the present invention and FIG. 4 is an exploded perspective view showing main components of the hydraulic breaker according to one embodiment of the present invention.

A hydraulic breaker 300 according to the present invention includes a back head 110 provided therein with a gas chamber; a cylinder 120 assembled to a lower portion of the back head 110; a front head 130 assembled to a lower portion of the cylinder 120; a piston 140 moving up and down in the cylinder 120; and a chisel 150 installed in the front head 130. Semicircular ring slots 111, 121 and 131 are defined in both sides of a bottom of the back head 110, both sides of a top of the cylinder 120, both sides of a bottom of the cylinder 120 and both sides of a top of the front head 130, respectively. In addition, fastening rings 160 are installed in circular ring slots formed by joining the semicircular ring slots 111 defined in both sides of the bottom of the back head 110 to the semicircular ring slots 121 defined in both sides of the top of the cylinder 120. In addition, the fastening rings 160 are installed in circular ring slots formed by joining the semicircular ring slots 121 define in both sides of the bottom of the cylinder 120 to the semicircular ring slots 131 defined in both sides of the top of the front head 130 in order to assemble the back head 110, the cylinder 120, and the front head 130 with each other.

According to the embodiment, pin holes 122 and 132 are formed in a front and a rear of the bottom of the back head 110 and a front and a rear of the top of the cylinder 120 in correspondence with each other. The pin holes 122 and 132 are formed in a front and a rear of the bottom of the cylinder 120 and a front and a rear of the top of the front head 130 in correspondence with each other. Position fixing pins 170 are installed in a pin hole (not shown) formed in the bottom of the back head 110 and the pin hole 122 formed in the top of the cylinder 120 corresponding to the pin hole of the back head 110. In addition, the position fixing pins 170 are also installed in the pin hole (not shown) formed in the bottom of the cylinder 120 and the pin hole 132 formed in the top of the front head 130 corresponding to the pin hole of the cylinder, in such a manner that the position fixing pins 170 serve as an assembling guide while permitting the fastening rings 160 to be stably fastened against rotation in forward or reverse direction.

Figure 5:
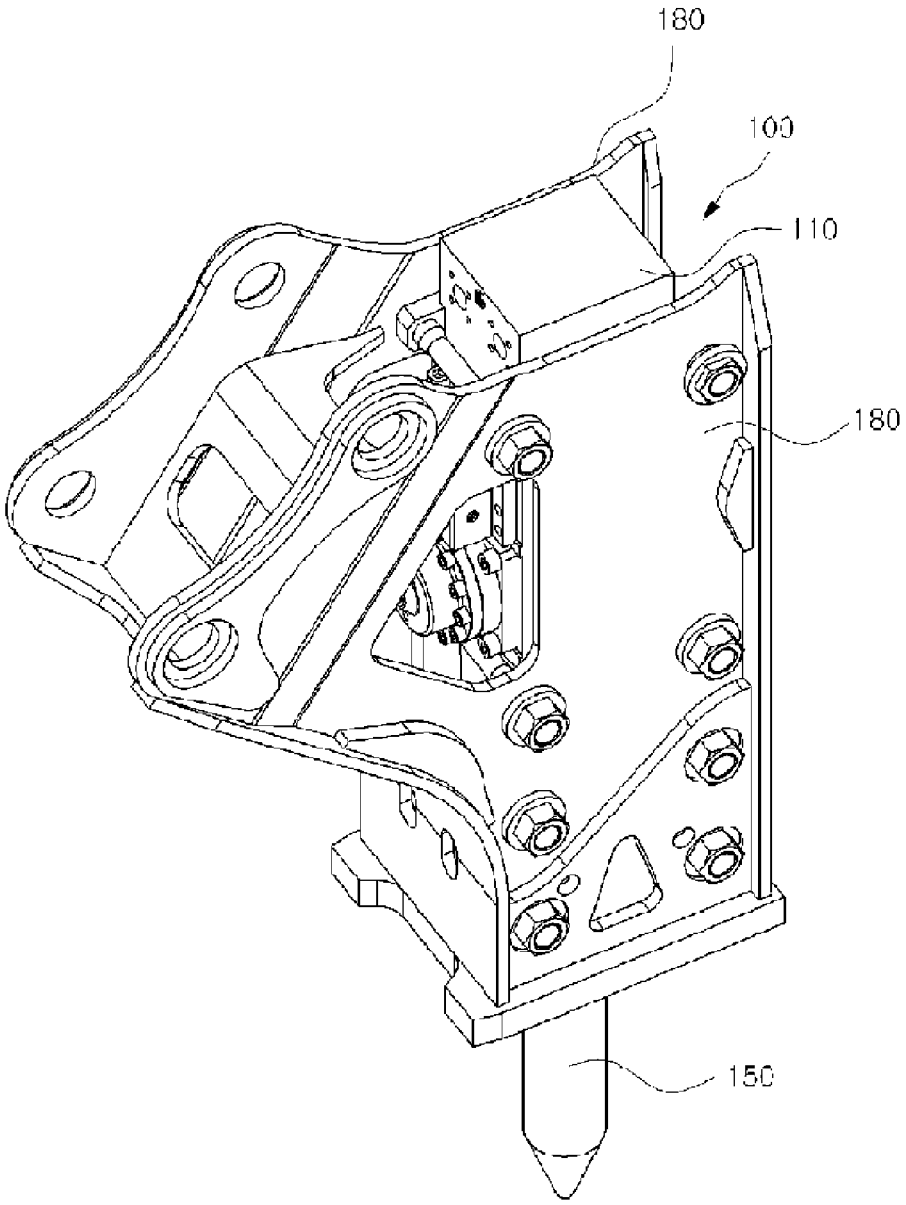
FIG. 5 is a perspective view showing the hydraulic breaker equipped with a connection bracket according to one embodiment of the present invention.

According to the hydraulic breaker 100 having the above structure, in a state that the cylinder 120 and the back head 110 are placed on the front head 130, the fastening rings 160 are installed in the circular ring slots formed by joining the semicircular ring slots 111 defined in both sides of the bottom of the back head 110 to the semicircular ring slots 121 defined in both sides of the top of the cylinder 120. In addition, the fastening rings 160 are installed in circular ring slots formed by joining the semicircular ring slots 121 define in both sides of the bottom of the cylinder 120 to the semicircular ring slots 131 defined in both sides of the top of the front head 130, thereby readily assembling the back head 110, the cylinder 120, and the front head 130 with each other. As shown in FIG. 5, the hydraulic breaker 100 is installed on the excavator by connection brackets 180 provided at both sides of the hydraulic breaker 100.

According to the hydraulic breaker 100 of the present invention, the fastening bolt having a long length is not used to assemble the back head, the cylinder, and the front head with each other, so it is not necessary to maintain tension by fastening the fastening bolt after the hydraulic breaker 100 installed on the excavator has been operated for a predetermined period of time. In addition, it is not necessary to inspect or fasten the fastening bolt even if the hydraulic breaker 100 has been operated for a long period of time.

While the hydraulic breaker 100 according to the present invention is being operated, a connection part between the front head 130 and the cylinder 120 and a connection part between the cylinder 120 and the back head 110 may be subject to the vibration. According to the related art, the front head, the cylinder and the back head are assembled with each other by using the fastening bolt and the fastening nut, so that a gap may be formed if the fastening nut is released caused by the vibration. However, according to the present invention, protrusion parts having sufficient strength are provided inside the ring slot 131 of the front head 130, the ring slot 121 of the cylinder 120 and the ring slot 111 of the back head 110. Thus, if the fastening rings 160 are press-fitted around the protrusions having contact surfaces, which are precisely polished, the fastening rings 160 can be prevented from being released or separated.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A hydraulic breaker comprising:

a back head provided therein with a gas chamber;

a cylinder assembled to a lower portion of the back head;

a front head assembled to a lower portion of the cylinder;

a piston moving up and down in the cylinder; and a chisel installed in the front head, wherein semicircular ring slots are defined in both sides of a bottom of the back head, both sides of a top of the cylinder, both sides of a bottom of the cylinder, and both sides of a top of the front head, respectively, and fastening rings are installed in circular ring slots formed by joining the semicircular ring slots defined in both sides of the bottom of the back head to the semicircular ring slots defined in both sides of the top of the cylinder, and the fastening rings are installed in circular ring slots formed by joining the semicircular ring slots defined in both sides of the bottom of the cylinder to the semicircular ring slots defined in both sides of the top of the front head in order to assemble the back head, the cylinder, and the front head with each other.

2. The hydraulic breaker of claim 1, wherein pin holes are formed in a front and a rear of the bottom of the back head and a front and a rear of the top of the cylinder in correspondence with each other, and the pin holes are formed in a front and a rear of the bottom of the cylinder and a front and a rear of the top of the front head in correspondence with each other, and wherein position fixing pins are installed in the pin holes formed in the bottom of the back head and the top of the cylinder in correspondence with each other, and the position fixing pins are installed in the pin holes formed in the bottom of the cylinder and the top of the front head in correspondence with each other, in such a manner that the position fixing pins serve as an assembling guide while permitting the fastening rings to be stably fastened against rotation in forward or reverse direction.

* * * * *